US009475073B2

(12) United States Patent
Kinne et al.

(10) Patent No.: US 9,475,073 B2
(45) Date of Patent: Oct. 25, 2016

(54) ELECTROSTATIC DISCHARGE CONTROL AND ISOLATION SYSTEM FOR SPRAYING SYSTEMS

(71) Applicant: Graco Minnesota Inc., Minneapolis, MN (US)

(72) Inventors: Robert W. Kinne, Minneapolis, MN (US); Steven R. Kuczenski, New Brighton, MN (US); Bradley H. Hines, Andover, MN (US); Dale C. Pemberton, Big Lake, MN (US); Jimmy W. Tam, Plymouth, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 1 day.

(21) Appl. No.: 14/742,154

(22) Filed: Jun. 17, 2015

(65) Prior Publication Data

US 2015/0283566 A1 Oct. 8, 2015

Related U.S. Application Data

(63) Continuation of application No. 13/990,715, filed as application No. PCT/US2012/021477 on Jan. 1, 2012, now Pat. No. 9,085,008.

(60) Provisional application No. 61/432,649, filed on Jan. 14, 2011.

(51) Int. Cl.

| | |
|---|---|
| ***B05B 15/00*** | (2006.01) |
| ***B05B 5/16*** | (2006.01) |
| ***B05B 9/08*** | (2006.01) |

(52) U.S. Cl.

CPC ..... *B05B 5/1691* (2013.01); *B05B 5/1675* (2013.01); *B05B 9/0861* (2013.01)

(58) Field of Classification Search

CPC ... B05B 5/1616; B05B 5/1625; B05B 15/00; B05B 5/16752; B05B 5/1691; B05B 5/06; B05B 5/08; B05B 5/087; B05B 9/0403; B05B 5/053; B05B 5/00; B05B 5/0255; B05B 5/035; B05B 5/025

USPC ..... 239/525, 526, 302, 375, 378, 690, 691, 239/690.1

See application file for complete search history.

(56) References Cited

U.S. PATENT DOCUMENTS 2,309,584 A * 1/1943 George ..... B64D 45/02 244/1 A
2,466,024 A * 4/1949 Hall ..... H04B 1/10 244/1 A (Continued)

FOREIGN PATENT DOCUMENTS

CN 101605610 A 12/2009
CN 101797538 A 8/2010

(Continued)

OTHER PUBLICATIONS

Taiwan Office Action for Taiwan Patent Application No. 101101652, dated May 12, 2016, 17 pages.

*Primary Examiner* — Justin Jonaitis
(74) *Attorney, Agent, or Firm* — Kinney & Lange, P.A.

(57) ABSTRACT

A fluid dispensing device includes an electrostatic discharge protection system. Accumulation and discharge of electrostatic energy created by operation of the device is reduced or prevented by the electrostatic discharge protection system without an earth ground connection. The electrostatic discharge protection system may include a number of features, such as a static wick, nonconductive components that electrically isolate the spray tip of the device, nonconductive isolation barriers, nonconductive fluid reservoir and suction tube components, a nonconductive coating of a control valve component, and a nonconductive spring retainer of the control valve.

31 Claims, 8 Drawing Sheets

(56) References Cited

U.S. PATENT DOCUMENTS

| | | | | | |
|---|---|---|---|---|---|
| 2,466,311 | A * | 4/1949 | Hall | B64D 45/02 | 244/1 A |
| 2,631,189 | A * | 3/1953 | Sullivan | B64D 45/02 | 174/102 SC |
| 3,260,893 | A * | 7/1966 | De La Cierva | B64D 45/02 | 340/946 |
| 3,617,805 | A * | 11/1971 | Truax | B64D 45/02 | 361/218 |
| 5,779,162 | A * | 7/1998 | Noakes | B05B 5/053 | 239/290 |
| 5,932,011 | A * | 8/1999 | Noakes | B05B 5/0255 | 118/300 |
| 6,318,647 | B1 * | 11/2001 | Gaw | B05B 5/1691 | 239/690 |
| 8,622,324 | B2 * | 1/2014 | Kelly | B05B 5/1691 | 239/328 |
| 2003/0006322 | A1 | 1/2003 | Hartle et al. | | |
| 2004/0004140 | A1 * | 1/2004 | Hsueh | H05F 3/04 | 239/690 |
| 2010/0072309 | A1 | 3/2010 | Hodge et al. | | |

FOREIGN PATENT DOCUMENTS

| | | |
|---|---|---|
| CN | 102413944 A | 4/2012 |
| TW | 181201 | 4/1992 |

* cited by examiner

FIG. 7A
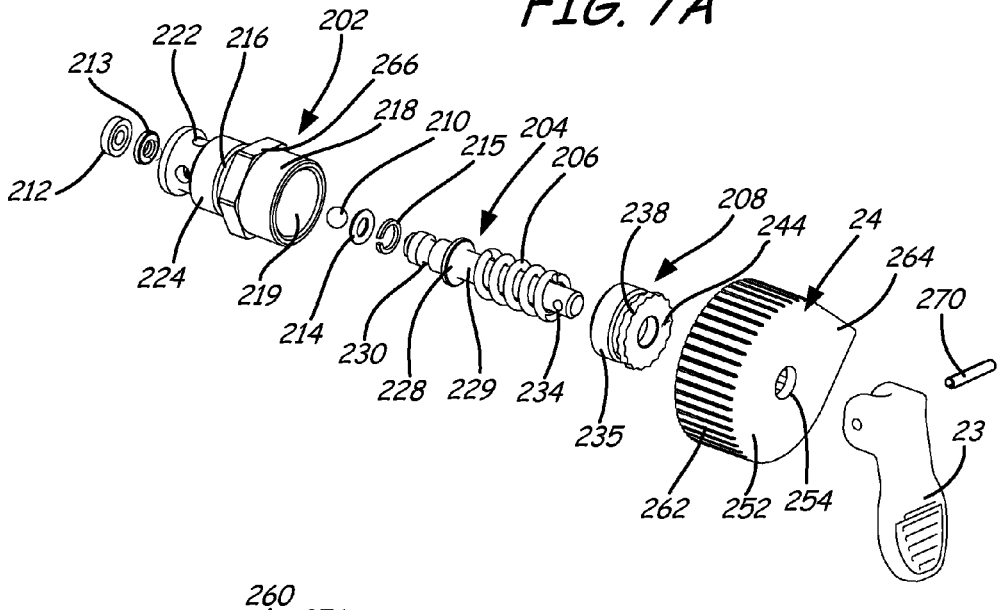
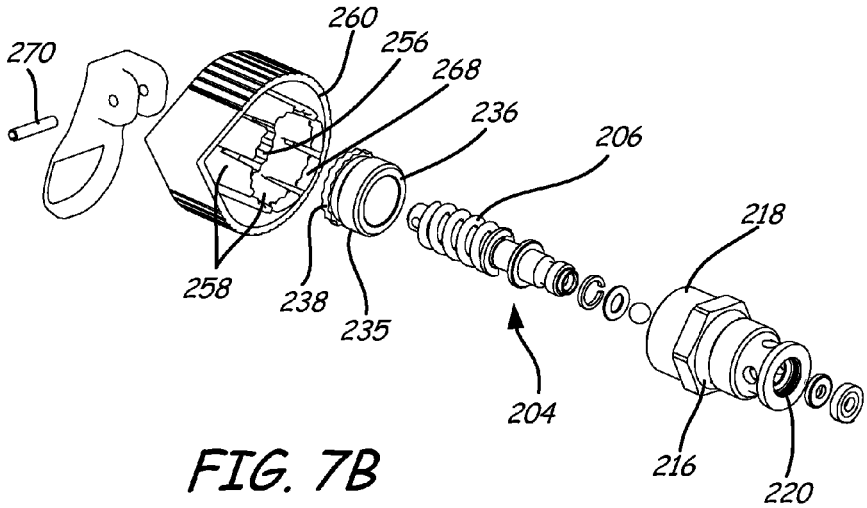
FIG. 7B

ELECTROSTATIC DISCHARGE CONTROL AND ISOLATION SYSTEM FOR SPRAYING SYSTEMS

CROSS-REFERENCE TO RELATED APPLICATIONS

This application is a continuation of U.S. application Ser. No. 13/990,715 filed May 30, 2013 for "Electrostatic Discharge Control and Isolation System For Spraying Systems" by Robert W. Kinne U.S. application Ser. No. 13/990,715 is the United States National phase of International Application PCT/US2012/021477, filed on Jan. 1, 2012, which claimed priority to U.S. Provisional Application 61/432,649, filed on Jan. 14, 2011.

BACKGROUND

The present invention is related to liquid dispensing systems. In particular, the present invention relates to spraying devices for dispensing paints, varnishes and the like, and to reducing or preventing the accumulation and/or discharge of electrostatic energy in a paint spraying device.

Paint sprayers are well known and popular for use in painting of surfaces, such as architectural structures, furniture and the like. Paint sprayers provide a high quality finish due to their ability to finely atomize liquid paint. These devices are typically coupled to a paint source, include a pumping mechanism that draws in the paint, and include a small, shaped orifice through which the paint is discharged. Paint sprayers are capable of pressurizing liquid paint to upwards, and in excess of, 3,000 psi [pounds per square inch] (~20.7 MPa).

Moving fluids can generate static-electric potential energy. The quantity of the energy generated can be influenced by any number of factors including, but not limited to, fluid pressure, fluid velocity, fluid composition, method of fluid movement, and source of fluid movement. It is typical in fluid dispensing applications that the equipment be placed in areas that are considered explosive-gas-atmospheres. If the energy generated through fluid movement is allowed to accumulate, it could reach levels at which discharge to ground and subsequent ignition of the explosive atmosphere could occur.

SUMMARY

A fluid dispensing device includes an electrostatic discharge protection system that prevents the accumulation and discharge of electrostatic energy in the device without an earth ground connection. The electrostatic discharge protection system regulates and isolates electrostatic energy to levels that will reduce the risk of igniting explosive atmospheres without a connection to earth ground. This allows for the application of flammable-based materials and coatings with a handheld spraying device.

BRIEF DESCRIPTION OF THE DRAWINGS

FIG. 7A shows an exploded view of the control valve of FIGS. 2-6 from an exterior perspective.

FIG. 7B shows an exploded view of the control valve of FIGS. 2-6 from an interior perspective.

DETAILED DESCRIPTION

During operation of fluid handling equipment, energy can be generated in the form of a static-electric potential difference to earth ground. This energy has the ability, and tendency, to accumulate on electrically conductive elements of the device. For cord-connected devices with a main-based power source, this energy can be neutralized through the ground leg of the power supply cable. Fluid handling equipment that is powered by a means that does not offer an immediate ground source can accumulate this energy, eventually reaching levels at which a discharge to ground can occur. The discharge of electrostatic energy, if occurring in an explosive atmosphere, could present a safety hazard.

The present invention protects against electrostatic discharge without a connection to earth ground. This is achieved by providing a static wick that is attached on one end to the energy accumulating elements of the fluid dispensing device. The active end of the static wick is exposed to air. The static wick discharges electrostatic potential energy into the air around its free end.

In addition, nonconductive or insulative barriers or coatings are used to create an increased discharge path between any charged conductive elements and any path to earth-ground. Nonconductive, rather than conductive, components are also strategically placed to electrically isolate conductive elements from each other, therefore reducing the total electric capacitance of the system. Examples of nonconductive elements include the front valve and nut of the spray tip assembly, the reservoir, and the suction tube.

Figure 8:
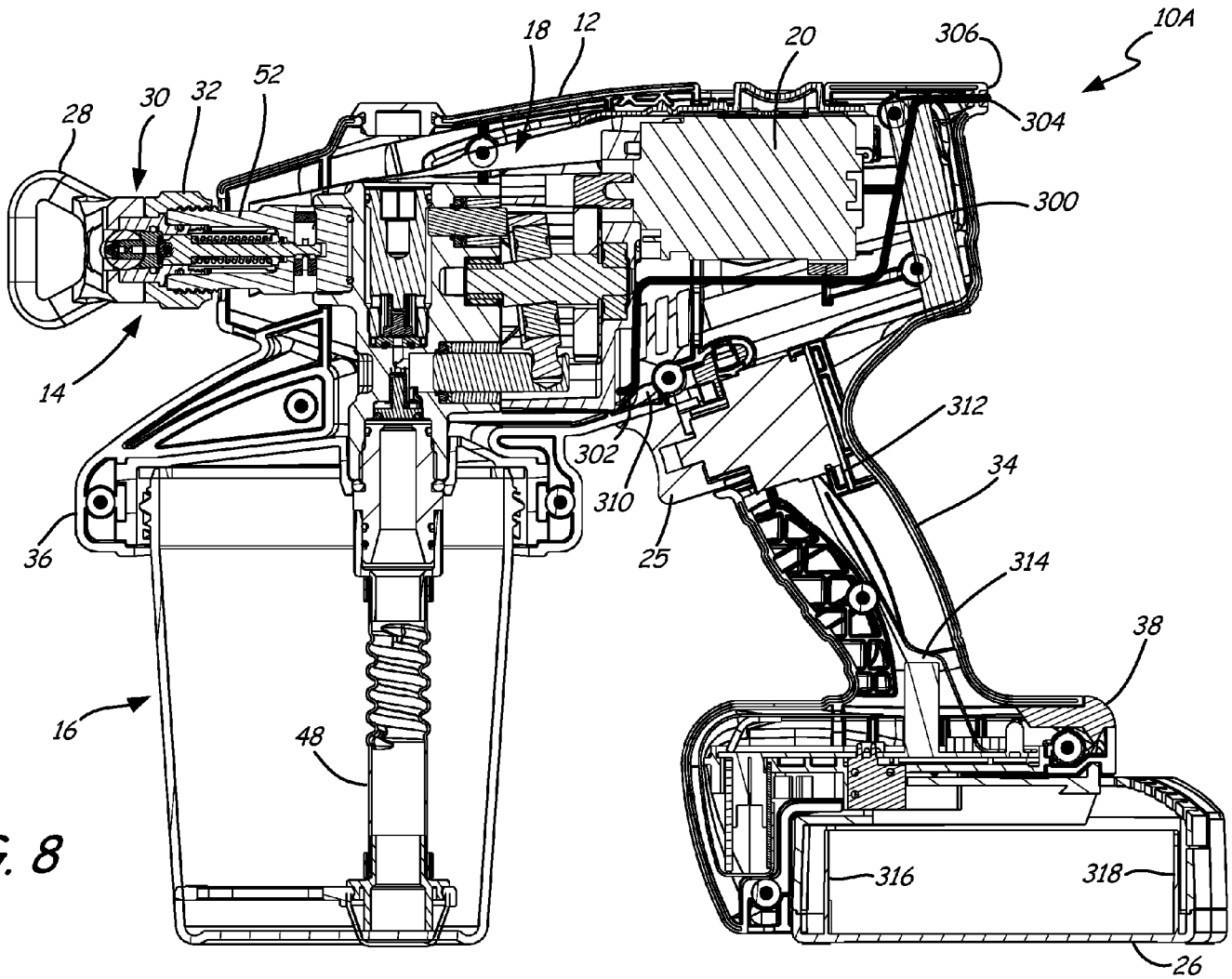
FIG. 8 shows a cross-sectional view of a handheld sprayer incorporating an electrostatic discharge protection system having static wick and isolation features for preventing the accumulation and discharge of static energy without an earth ground connection.

In the following discussion, the design and operation of a portable airless dispensing device such as a paint sprayer will be provided with reference to FIGS. 1 through 7B, in order to illustrate one example of a dispensing device in which the electrostatic discharge protection can be used. In FIG. 8, a handheld sprayer generally similar to the paint sprayer of FIGS. 1 through 7B and incorporating an electrostatic discharge protection system is shown in a cross-sectional view. Static wick and the various isolation and capacitance reduction features of the handheld sprayer are illustrated in FIG. 8 and in FIG. 6. It should be understood that the electrostatic discharge protection system is applicable to a wide variety of fluid dispensing devices, and is not limited to the specific paint sprayers shown in FIGS. 1 through 8.

Figure 1:
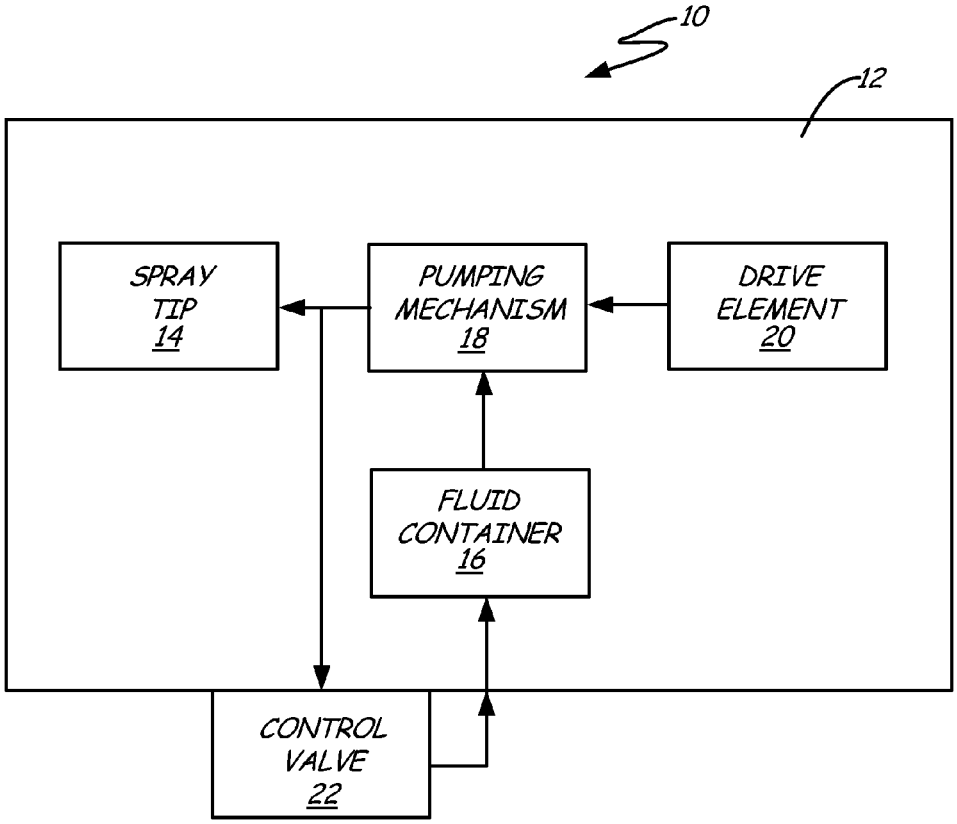
FIG. 1 shows a block diagram of the main components of an airless fluid dispensing device.

FIG. 1 shows a block diagram of portable airless fluid dispensing device 10. In the embodiment shown, device 10 comprises a portable airless spray gun comprising housing 12, spray tip assembly 14, fluid container 16, a fluid delivery device formed by pumping mechanism 18 and drive element 20, and control valve 22. In various embodiments of the invention, spray tip assembly 14, fluid container 16, pumping mechanism 18, drive element 20 and control valve 22 are packaged together in a portable spraying system. For example, spray tip assembly 14, fluid container 16, pumping mechanism 18, drive element 20 and control valve 22 can each be mounted directly to housing 12 to comprise an integrated handheld device, as described with respect to FIGS. 2 and 3.

Spray gun 10 comprises an airless dispensing system in which pumping mechanism 18 draws fluid from container 16 and, with power from drive element 20, pressurizes the fluid for atomization through spray tip assembly 14. Pumping mechanism 18 comprises, in different embodiments, a gear pump, a piston pump, a plunger pump, a vane pump, a rolling diaphragm pump, a ball pump, a rotary lobe pump, a diaphragm pump or a servo motor having a rack and pinion drive. Drive element 20 comprises, in different embodiments, an electric motor, an air-driven motor, a linear actuator or a gas engine which can be used to drive a crankshaft, cams, a wobble plate or rocker arms. In various embodiments, pumping mechanism 18 generates orifice spray pressure, or running pressure, from about 360 pounds per square inch [psi] (~2.48 MPa) up to about 3,000 psi (~20.7 MPa), or higher. Control valve 22 permits an operator to adjust pressures and flow rates generated by pumping mechanism 18 independent of the speed of pumping mechanism 18.

Figure 2:
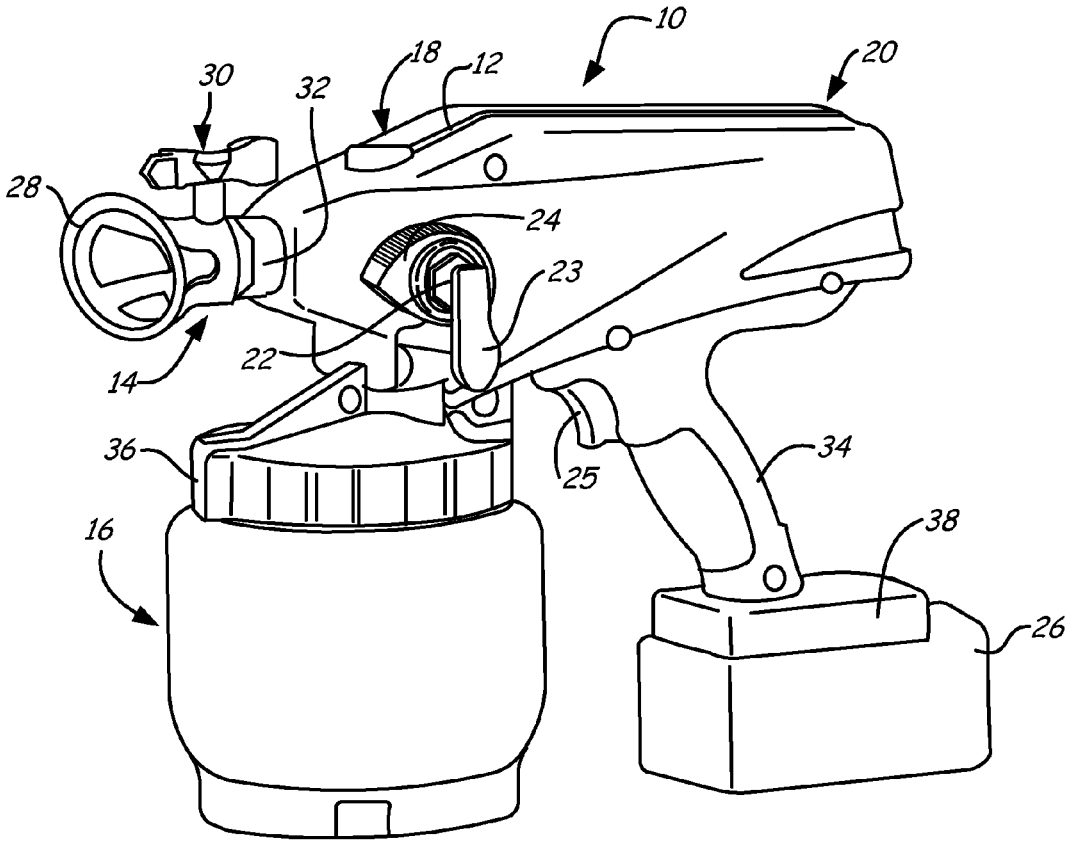
FIG. 2 shows a side perspective view of a handheld sprayer embodiment of the dispensing device of FIG. 1.

FIG. 2 shows a side perspective view of spray gun 10 having housing 12, spray tip assembly 14, fluid container 16, pumping mechanism 18 (FIG. 3), drive element 20 (FIG. 3) and control valve 22. Control valve 22 includes lever 23 and knob 24. Spray gun 10 also includes trigger 25 and battery 26. Spray tip assembly 14 includes guard 28, spray tip 30 and connector 32. Drive element 20 and pumping mechanism 18 are disposed within housing 12. Housing 12 includes integrated handle 34, container lid 36 and battery port 38.

Fluid container 16 is provided with a fluid that is desired to be sprayed from spray gun 10. For example, fluid container 16 is filled with a paint or varnish that is fed to spray tip assembly 14 through coupling with lid 36. Battery 26 is plugged into battery port 38 to provide power to drive element 20 within housing 12. Trigger 25 is connected to battery 26 and drive element 20 such that upon actuation of trigger 25 a power input is provided to pumping mechanism 18. Pumping mechanism 18 draws fluid from container 16 and provides pressurized fluid to spray tip assembly 14. Connector 32 couples spray tip assembly 14 to pump 18. Tip guard 28 is connected to connector 32 to prevent objects from contacting high velocity output of fluid from spray tip 30. Spray tip 30 is inserted through bores within tip guard 28 and connector 32 and includes a spray orifice that receives pressurized fluid from pumping mechanism 18. Spray tip assembly 14 provides a highly atomized flow of fluid to produce a high quality finish. Control valve 22 of the present invention permits an operator to, among other things, open pumping mechanism 18 to atmospheric pressure using lever 23, and adjust the maximum spray pressure of spray gun 10 using knob 24.

Figure 3:
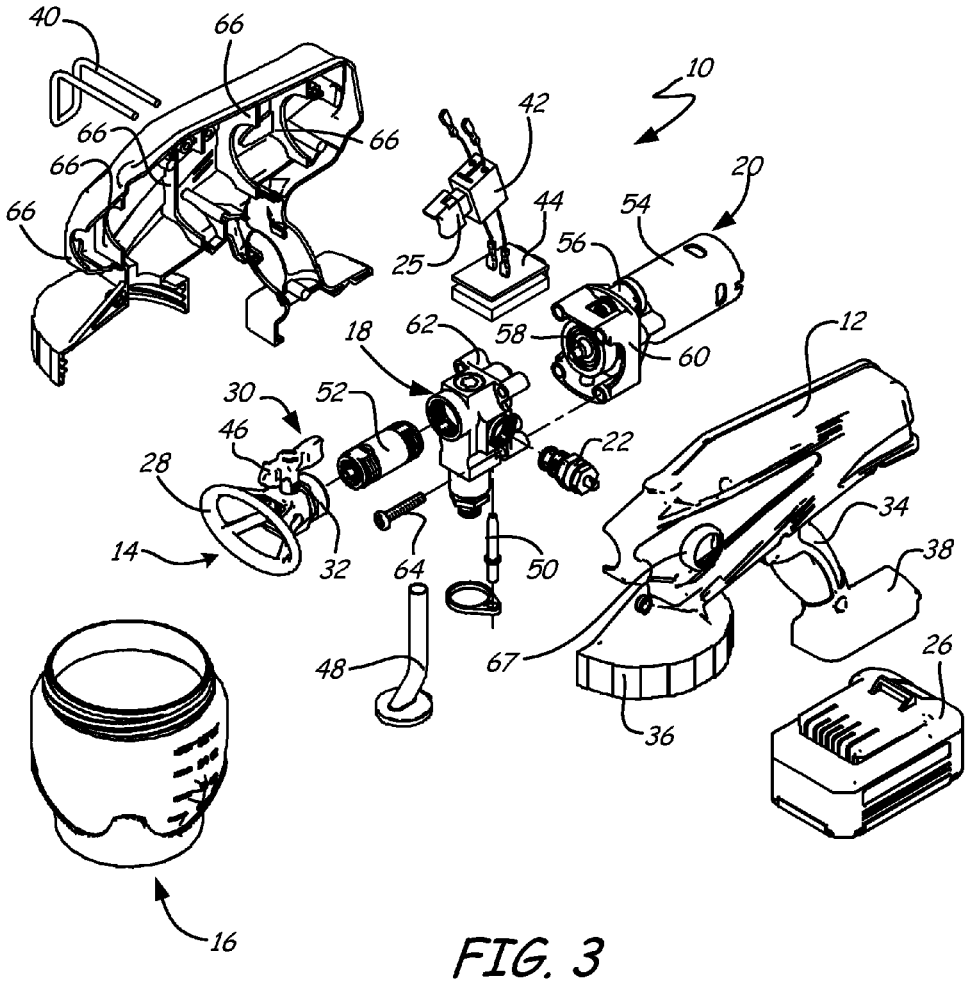
FIG. 3 shows an exploded view of the handheld sprayer of FIG. 2, showing a housing, a spray tip assembly, a fluid cup, a pumping mechanism, a drive element and the control valve.

FIG. 3 shows an exploded view of spray gun 10 having housing 12, spray tip assembly 14, fluid container 16, pumping mechanism 18, drive element 20 and control valve 22. Spray gun 10 also includes trigger 25, battery 26, clip 40, switch 42 and circuit board 44. Spray tip assembly 14 includes guard 28, spray tip 30, connector 32 and barrel 46. Pumping mechanism 18 includes suction tube 48, return line 50 and valve 52. Drive element 20 includes motor 54, gearing assembly 56 and wobble drive assembly 58. Housing 12 includes integrated handle 34, container lid 36 and battery port 38.

Pumping mechanism 18, drive element 20, gearing 56, wobble drive assembly 58 and valve 52 are mounted within housing 12 and supported by various brackets. For example, gearing 56 and wobble drive assembly 58 include bracket 60 which connects to housing 62 of pumping mechanism 18 using fasteners 64. Valve 52 is threaded into housing 62, and connector 32 of spray tip 30 is threaded onto valve 52. Spray tip 30, valve 52, pumping mechanism 18 and drive element 54 are supported within housing 12 by ribs 66. Switch 42 is positioned above handle 34 and circuit board 44 is positioned below handle 34 such that trigger 25 is ergonomically positioned on housing 12. Switch 42 includes terminals for connecting with drive element 20, and battery 26 is supported by port 38 of housing 12 in such a manner so as to connect with circuit board 44. Battery 26 may comprise a Lithium battery, a Nickel battery, a Lithium-ion battery or any other suitable rechargeable battery. In one embodiment, battery 26 comprises a 18 VDC battery, although other lower or higher voltage batteries can also be used. Fluid container 16 is threaded into lid 36 of housing 12. Suction tube 48 and return line 50 extend from pumping mechanism 18 into fluid container 16. Clip 40 allows gun 10 to be conveniently stowed such as on a belt of an operator or a storage rack.

To operate spray gun 10, fluid container 16 is filled with a liquid to be sprayed from spray tip 30. Trigger 25 is actuated by an operator to activate drive element 20. Drive element 20 draws power from battery 26 and causes rotation of a shaft connected to gearing 56. Gearing 56 causes wobble drive 58 to provide an actuation motion to pumping mechanism 18. Pumping mechanism 18 draws liquid from container 16 using suction tube 48. Air in the pump, or fluid flow greater than needed, is returned to container 16 through control valve 22 and return line 50. Pressurized liquid from pumping mechanism 18 is provided to valve 52. Once a threshold pressure level is achieved, valve 52 opens to allow pressurized liquid into barrel 46 of spray tip 30. Barrel 46 includes a spray orifice that atomizes the pressurized liquid as the liquid leaves spray tip 30 and gun 10. Barrel 46 may comprise either a removable spray tip that can be removed from tip guard 28, or a reversible spray tip that rotates within tip guard 28. Control valve 22 is inserted through access flange 67 and connected to pumping mechanism 18 to provide 1) a priming valve, 2) a rapid depressurization valve, 3) a safety valve and 4) a pressure adjustment valve.

Figure 4:
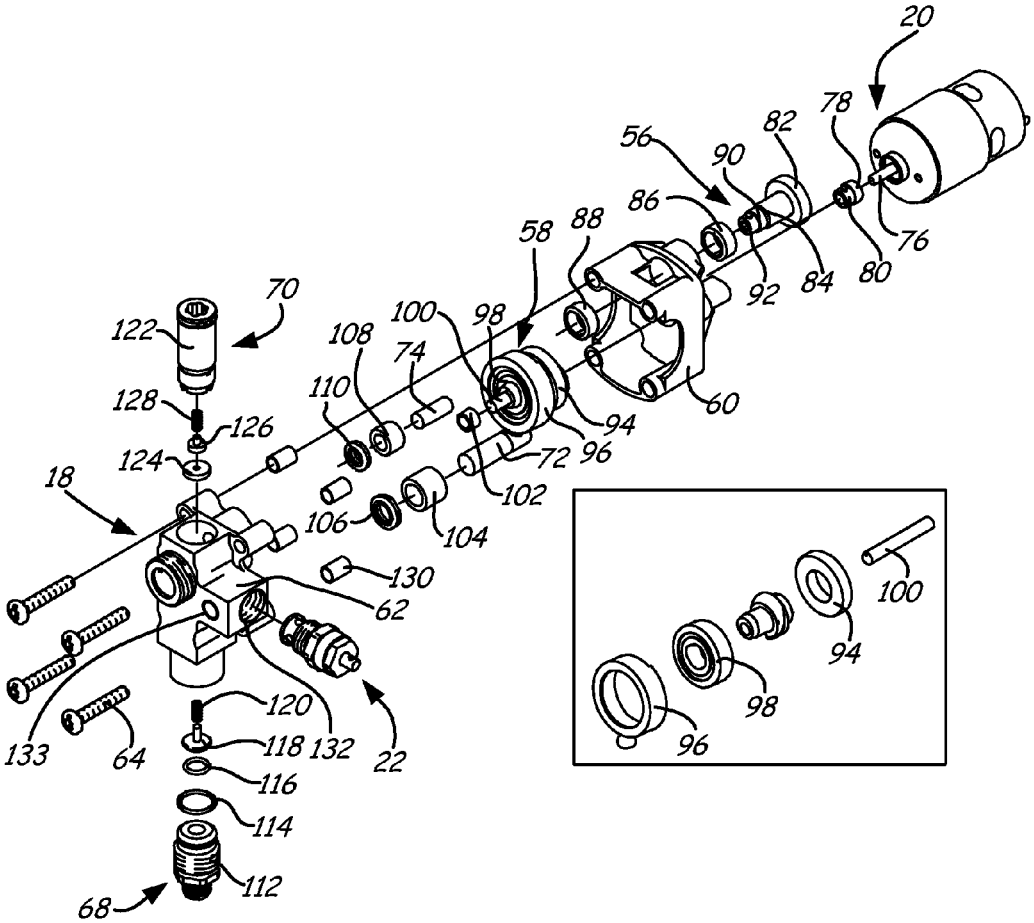
FIG. 4 shows an exploded view of the pumping mechanism and drive element of FIG. 3.

FIG. 4 shows an exploded view of pumping mechanism 18 and drive element 20 of FIG. 3. Pumping mechanism 18 includes housing 62, fasteners 64, inlet valve assembly 68, outlet valve assembly 70, first piston 72 and second piston 74. Drive element 20 includes drive shaft 76, first gear 78, first bushing 80, second gear 82, shaft 84, first bushing 86, third bushing 88, third gear 90, fourth bushing 92 and fourth gear 94. Wobble drive mechanism 58 includes connecting rod 96, bearing 98, rod 100 and sleeve 102. First piston 72 includes first piston sleeve 104 and first piston seal 106. Second piston 74 includes second piston sleeve 108 and second piston seal 110. Inlet valve 68 includes inlet valve cartridge 112, seal 114, seal 116, inlet poppet valve 118 and inlet spring 120. Outlet valve 70 includes outlet valve cartridge 122, seat 124, outlet poppet valve 126 and outlet spring 128.

Drive shaft 76 is inserted into bushing 80 such that gear 78 rotates when drive element 20 is activated. Bushings 86 and 88 are inserted into a receiving bore within bracket 60, and shaft 84 is inserted into bushings 86 and 88. Gear 82 is connected to a first end of shaft 84 to mesh with gear 78, and gear 90 is connected with a second end of shaft 84 to mesh with gear 94. Sleeve 102 is inserted into a receiving bore within housing 62 and rod 100 is inserted into sleeve 102 to support wobble drive mechanism 58. Bearing 98 connects rod 100 to connecting rod 96. Connecting rod 96, which comprises a ring with a stud, couples with first piston 72. First piston 72 and second piston 74 are inserted into piston sleeves 104 and 108, respectively, which are mounted within pumping chambers within housing 62. Valve seals 106 and 110 and sleeves 104 and 108 seal the pumping chambers. Fasteners 64 are inserted through bores in housing 62 and bushings 130 and threaded into housing 60. Inlet valve cartridge 112 is inserted into a receiving bore in bracket 62. Inlet spring 120 biases poppet valve 118 against cartridge 112. Similarly, outlet valve cartridge 122 is inserted into a receiving bore in housing 62 such that outlet spring 128 biases poppet valve 126 against seat 124. Seals 114 and 116 prevent fluid from leaking out of valve 68, and seat 124 prevents fluid from leaking out of valve 70. Control valve 22 is inserted into receiving bore 132 in housing 62 to intersect fluid flow from pistons 72 and 74 and to intersect vent 133. Vent 133 can be positioned on an underside of housing 62 for coupling to return line 50 as shown in FIG. 3. Control valve 22 is adjustable to permit an operator to manually set the maximum pressure that will be generated within pumping mechanism 18.

Figure 5:
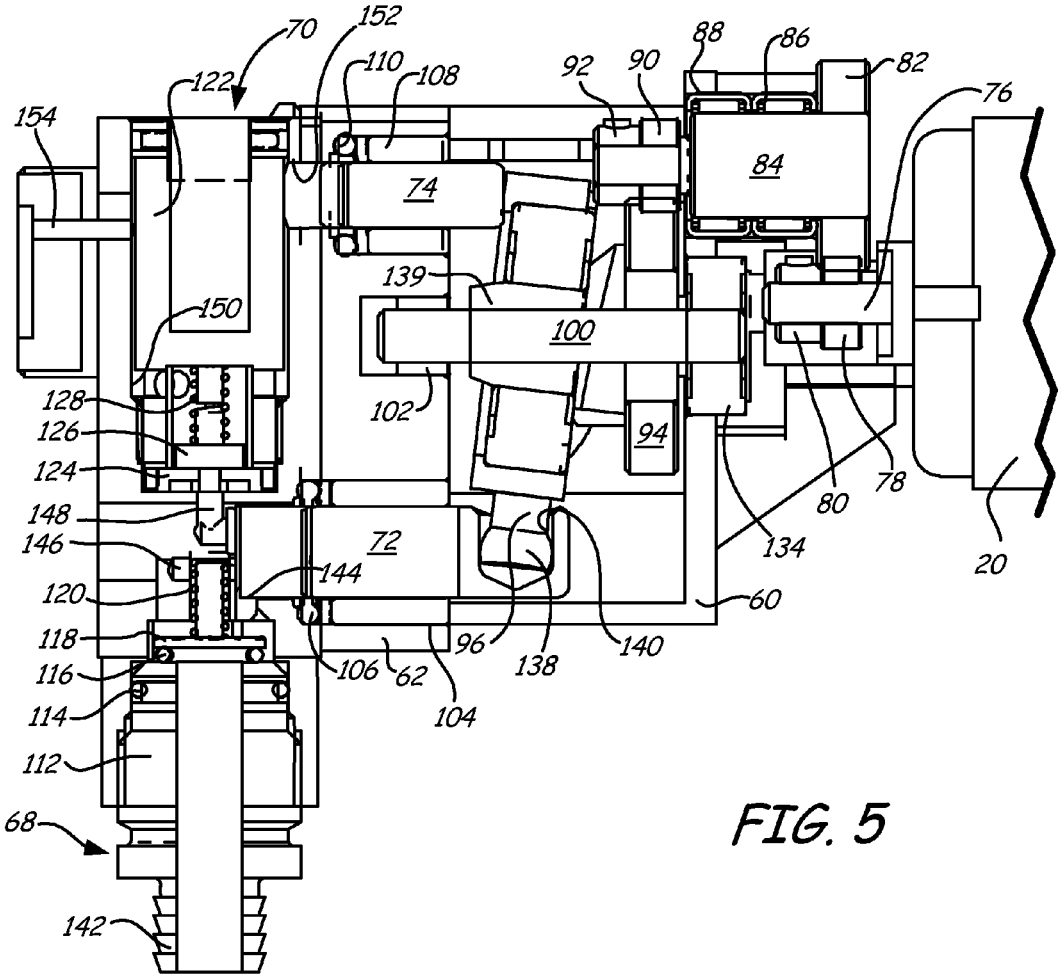
FIG. 5 shows a cross-sectional view of an assembled pumping mechanism and drive element.

FIG. 5 shows a cross-sectional view of pumping mechanism 18 assembled with drive element 20. Drive element 20 comprises a mechanism or motor for producing rotation of drive shaft 76. In the embodiment shown, drive element 20 comprises a DC (direct current) motor that receives electrical input from battery 26, or another electrical power source. In other embodiments, drive element comprises an AC (alternating current) motor that receives electrical input from a power outlet or a pneumatic motor that receives compressed air as an input. Pumping mechanism 18 comprises a dual piston pump. In other embodiments, pumping mechanism 18 may comprise a double-displacement single piston pump, a gerotor (generated rotor), a gear pump or a rotary vane pump.

First gear 78 is fit over drive shaft 76 and is held in place by bushing 80. Bushing 80 is secured to shaft 76 using a setscrew or another suitable means. First gear 78 meshes with second gear 82, which is connected to shaft 84. Shaft 84 is supported in bracket 60 by bushings 86 and 88. Gear 90 is disposed on a reduced diameter portion of shaft 84 and secured in place using bushing 92. Bushing 92 is secured to shaft 84 using a setscrew or another suitable means. Gear 90 meshes with gear 94 to rotate rod 100. Rod 100 is supported by sleeve 102 and bushing 134 in housings 62 and 60, respectively. Gears 78, 82, 90 and 94 provide a gear reduction means that slows the input to rod 100 from the input provided by drive element 20.

Rotation of rod 100 produces linear motion of ball 138 of connecting rod 96 through wobble of hub 139. Ball 138 is mechanically connected to socket 140 of piston 72. Thus, connecting rod 96 directly actuates piston 72 in both advanced and retracted positions. Piston 72 advances and retracts within piston sleeve 104 in housing 62. As piston 72 retreats from the advanced position, fluid is drawn into valve 68. Valve 68 includes stem 142 to which suction tube 48 connects. Suction tube 48 is submerged within a liquid inside fluid container 16 (FIG. 3). The liquid is drawn into pumping chamber 144 around poppet valve 118 and through inlet 146. Poppet valve 118 is biased against valve cartridge 112 by spring 120. Seal 116 prevents fluid from passing between cartridge 112 and poppet valve 118 when poppet valve 118 is closed. Seal 114 prevents fluid from passing between cartridge 112 and housing 62. Valve stem 118 is drawn away from cartridge 112 by suction produced by piston 72. As piston 72 advances, fluid within pumping chamber 144 is pushed through outlet 148 toward valve 70.

Fluid pressurized in chamber 144 is pushed into pressure chamber 150 around poppet valve 126 of valve 70. Poppet valve 126 is biased against seat 124 by spring 128. Seat 124 prevents fluid from passing between poppet valve 126 and housing 62 when valve 126 is closed. Poppet valve 126 is forced away from housing 62 as piston 72 moves toward the advanced position, as spring 120 and the pressure generated by piston 72 closes valve 68. Pressurized fluid from pumping chamber 144 fills pressure chamber 150, comprising the space between cartridge 122 and housing 62, and pumping chamber 152. The pressurized fluid also forces piston 74 to the retracted position. The volume displaced by the advance of piston 72 is larger than the displacement of piston 74. As such, a single stroke of piston 72 provides enough fluid to fill pumping chamber 152 and maintain pressure chamber 150 filled with pressurized fluid. Additionally, piston 72 has a large enough volume to push pressurized fluid through outlet 154 of housing 62.

As piston 72 retreats to draw additional fluid into pumping chamber 144, piston 74 is pushed forward by connecting rod 96. Piston 74 is disposed within piston sleeve 108 in housing 62, and piston seal 110 prevents pressurized fluid from escaping pumping chamber 152. Piston 74 advances to evacuate fluid pushed into pumping chamber 152 by piston 72. The fluid is pushed back into pressure chamber 150 and through outlet 154 of housing 62, but is prevented by valve 70 from entering chamber 148. Piston 72 and piston 74 operate out of phase with each other. For the specific embodiment shown, piston 74 is one-hundred eighty degrees out of phase with piston 72 such that when piston 74 is at its most advanced position, piston 72 is at its most retracted position. Operating out of phase, pistons 72 and 74 operate in synch to provide a continuous flow of pressurized liquid to pressure chamber 150 while also reducing vibration in spray gun 10. Pressure chamber 150 acts somewhat as an accumulator to provide a more constant flow of pressurized fluid to outlet 154 such that a continuous flow of liquid can be provided to valve 52 and spray tip assembly 14 (FIG. 3). Receiving bore 132 (FIG. 4) of housing 62 extends to intersect pressure chamber 150. Control valve 22 is inserted in receiving bore 132 and is configured to automatically open when pressures generated by pumping mechanism 18 in pressure chamber 150 exceed a threshold level set by control valve 22 or when manually actuated.

Figure 6:
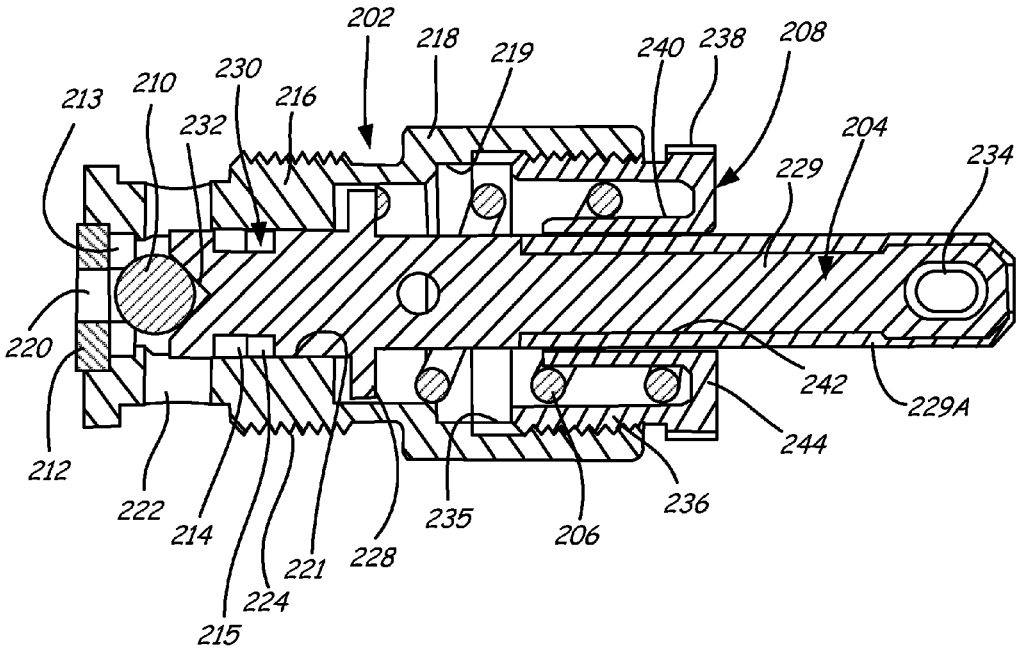
FIG. 6 shows a cross-sectional view of a control valve used in the pumping mechanism of FIGS. 3-5.

FIG. 6 shows a cross-sectional view of control valve 22 used in pumping mechanism 18 of FIGS. 3-5. Control valve 22 includes housing 202, plunger 204, spring 206, cap 208, ball 210, gasket 212, seat 213, O-ring seal 214 and backup ring 215. Body 202 comprises base 216, cup 218, spring bore 219, inlet bore 220, stem bore 221, outlet bore 222 and body threads 224. Plunger 204 comprises flange 228, stem 229 with non-conductive coating 229A, seal seat 230, ball guide 232 and lever bore 234. Cap 208 comprises cap threads 235, outer sleeve 236, scalloped rim 238, inner sleeve 240, which defines valve bore 242, and end wall 244.

Using body threads 224, annular valve body 202 is threaded into receiving bore 132 (FIG. 4) of housing 62 to intersect pressure chamber 150 (FIG. 5). Inlet bore 220 is fluidly coupled to pressure chamber 150 and is therefore exposed to the fluid pressure generated by pumping mechanism 18. Outlet bore 222 extends through body 202 to align with a vent, such as vent 133, in housing 62 to receive return line 50 (FIG. 3), which extends into fluid container 16 (FIG. 3). As such, a complete circuit is formed between fluid container 16, suction tube 48, pumping mechanism 18, pressure chamber 150, relief valve 22 and return line 50.

Plunger 204 is inserted into stem bore 221 through cup 218 such that flange 228 is disposed within spring bore 219 and stem 229 extends through and out of cup 218. Spring bore 219 comprises a larger diameter extension of stem bore 221. Seat 213 is disposed between housing 62 and body 202 within inlet bore 220. Gasket 212 is pushed into inlet bore 220 to maintain assembly of seat 213 and ball 210 within valve body 202. When control valve 22 is fully assembled, ball guide 232 of plunger 204 holds ball 210 against seat 213 to prevent fluid from pressure chamber 150 from passing through inlet bore 220 and into outlet bore 222. O-ring seal 214 is positioned within seal seat 230 between body 202 and plunger 204 to prevent fluid within bore 222 from entering bore 219 when plunger 204 is retraced from seat 213. Backup ring 215, which comprises a split ring or washer, is positioned around valve stem 229 to prevent extrusion of o-ring 214 into stem bore 221. Spring 206 is positioned within bore 219 to push against flange 228 and cap 208. Cap threads 235 on outer sleeve 236 of cap 208 are threaded into bore 219 on cup 218 such that stem 229 extends into inner sleeve 240 and through end wall 244. Cap 208 comprises a spring retainer that puts spring 206 in compression to bias plunger 204 toward seat 213 and housing 62. As discussed below, knob 24 and lever 23 (shown in FIGS. 2, 7A and 7B) are slipped over valve stem 229. Knob 24 engages scalloped rim 238 and lever 23 couples to lever bore 234.

Valve 22 provides priming means for pumping mechanism 18. Upon initiating a new use of spray gun 10, before fluid has filled pumping mechanism 18, it is necessary to purge air from within spray gun 10 before buildup of pressure is possible. Lever 23 (FIG. 1; FIGS. 7A & 7B), which is connected to stem 204 by a pin at bore 234, can be pushed or pulled by an operator to withdraw plunger away from seat 212 via cam action with face 252 which causes ball 210 to disengage from seat 213. Thus, upon activation of pumping mechanism 18, air from within spray gun 10 is displaced by fluid from container 16 and purged from spray gun 10 through vent 133. Likewise, as fluid begins to flow from container 16, control valve 22 re-circulates the fluid back to container 16. When lever 23 is released, valve 52 (FIG. 3) will open upon appropriate fluid pressure to keep fluid pressure to spray tip 14 consistent.

Valve 22 also provides a means for rapidly depressurizing spray gun 10 after use. For example, after operation of spray gun 10 when drive element 20 has ceased operating pumping mechanism 18, pressurized fluid remains within spray gun 10. It is, however, desirable to depressurize spray gun 10 such that spray gun 10 can be disassembled and cleaned. Thus, displacement of lever 23 opens valve 22 to drain pressurized fluid within pumping mechanism to container 16 and to release any stored potential energy within spray gun 10.

Valve 22 also comprises a safety valve to prevent pumping mechanism 18 from becoming over-pressurized. Depending on the preload setting of spring 206, plunger 204 will be displaced when pressure within pressure chamber 150 reaches a desired threshold level. At such level, pressure chamber 150 is fluidly connected to bore 222 to allow liquid within pressure chamber 150 to travel into vent 133. Thus, the liquid is returned to container 16 and can be recycled by pumping mechanism 18.

Notably, this response also allows the valve to be used as a control for the spraying pressure delivered to tip 14. Here, cap 208 of valve 22 comprises an adjustment mechanism that permits variation of the compression induced in spring 206, thereby changing the maximum pressure that can be generated by pumping mechanism 18. In the embodiment shown, cap threads 235 on outer sleeve 236 engage internal threads on cup 218 to permit cap 208 to be rotated to adjust its position relative to base 216 and flange 228. In other embodiments, other mechanisms can be used, such as a bimodal button mechanism that adjusts the compression of spring 206 between two settings. In one embodiment, valve 22 can be configured to open up anywhere between 1,000 psi (~6.9 MPa) and 3,000 psi (~20.7 MPa). In the described embodiment, knob 24 (FIG. 1; FIGS. 7A & 7B) is adjusted to rotate outer sleeve 236 within cup 218 to adjust the spring compression.

FIG. 7A shows an exploded view of control valve 22 of FIGS. 2-6 from an exterior perspective. FIG. 7B shows an exploded view of control valve 22 of FIGS. 2-6 from an interior perspective. FIGS. 7A and 7B are discussed concurrently. Control valve 22 comprises body 202, plunger 204, spring 206, cap 208, ball 210, gasket 212, seat 213, O-ring seal 214 and backup ring 215. Body 202 comprises base 216, cup 218, spring bore 219, inlet bore 220, outlet bore 222 and body threads 224. Plunger 204 comprises flange 228, stem 229, seal seat 230 and lever bore 234. Cap 208 comprises cap threads 235, outer sleeve 236, scalloped rim 238, inner sleeve 240, which defines valve bore 242, and end wall 244. Knob 24 comprises end face 252, stem bore 254, scalloped ring 256, pliable fingers 258 and dial 260. Dial 260 includes grips 262 and indicator 264. Valve body 202 includes faceted surface 266.

Outer sleeve 236 of cap 208 is threaded into cup 218 of valve body 202. Knob 24 is coupled to cap 208 via a spline connection that permits relative axial movement, but that prevents relative rotational movement. Specifically, scalloped ring 256 of end face 252 slide into engagement with scalloped rim 238 of cap 208. As such, knob 24 is locked into circumferential engagement with cap 208. With ring 256 and rim 238 engaged, pliable fingers 258 are pushed across cup 218 and over faceted surface 266. Pliable fingers 258 deflect radially outwardly to hug the radially outer perimeter of faceted surface 266. However, sufficient force can be used to overcome the force of pliable fingers 258 to rotate fingers 258 circumferentially across surface 266, or to remove knob 24 axially from cap 208. Specifically, pliable fingers 258 can be situated into a plurality of preset positions along faceted surface 266, as discussed below. Axial movement of knob 24 is limited by the retention of the pin 270 and lever 23.

Pliable fingers 258 provide tactile indications of the position of cap 208 such that an operator can move knob 24 in even increments. In the embodiment shown, faceted surface 266 comprises a hexagonal cross-sectional area providing six flat surfaces and six edges against which pliable fingers 258 engage. Specifically, the interior facing surfaces of pliable fingers 258 include crenellations that are shaped to engage the edges of faceted surface 266. In the embodiment shown, eight pliable fingers 258 include sixteen crenellations plus an additional eight spaces between the fingers that produce a total of twenty-four positions of pliable fingers 258 relative to faceted surface 266. In such an embodiment, however, knob 24 is restricted to rotating 270 degrees such that eighteen adjustments, thus, nineteen positions are provided. Indicator 264 provides a visual indication to an operator of the position of cap 208 relative to valve body 202. Indications can be provided on housing 12 (FIG. 1) to provide a visual representation of the position of knob 24, of pressure or of flow.

FIG. 8 is a cross-sectional view of portable airless spray gun 10A, which is generally similar to spray gun 10 shown in FIGS. 1-7B and described above. Components in spray gun 10A that are similar (although not necessarily identical to) components of spray gun 10 are designated with the same reference number. Thus, spray gun 10A includes housing 12, spray tip assembly 14, fluid container 16, pumping mechanism 18, drive element 20, and control valve 22 (which is not shown in FIG. 8, but which is the same as illustrated in FIGS. 1-7B). Spray tip assembly 14 includes guard 28, spray tip 30, and connector or nut 32. Nut 32 threads on to front valve 52.

Housing 12 includes integrated handle 34, container lid 36, and battery port 38. Battery case 26 is plugged into battery port 38 to provide power to drive element 20 so that upon actuation of trigger 25, pumping mechanism 18 is driven by drive element 20. Pumping mechanism 18 is similar to the pumping mechanism described with respect to spray gun 10, and operates in a similar fashion. The fluid being sprayed is contained within fluid container 16, and is drawn into pumping mechanism 18 through suction tube 48. Pistons within pumping mechanism 18 reciprocate, and supply the fluid under pressure through front valve 52 to spray tip assembly 14.

Spray gun 10A includes an electrostatic discharge protection system that prevents the accumulation and discharge of static energy in sprayer 10A without an earth ground connection. The system includes several different elements that contribute to preventing the accumulation and discharge of static energy that could pose a safety hazard. A first feature of the electrostatic discharge protection system is static wick 300, which is a conductive wire connected at first end 302 to the electrostatic energy accumulating element of the paint sprayer. Static wick 300 extends from first end 302 to second end 304, which is exposed to open air on the exterior of spray gun 10A. In the embodiment shown in FIG. 8, second end or tip 304 of static wick 300 extends out of housing 12 through port 306 which is located at the rear end of housing 12. The location of second end 304 is distant from spray tip assembly 14, as well as from fluid container 16 and battery 26, but could be located in any location in other embodiments of the paint sprayer.

Static wick 300 may be formed of a single small diameter wire, multiple wires, or any other conductive geometric object, the purpose of which is to discharge electrostatic energy to the surrounding air rather than through a connection to earth ground. At second end 304, wick 300 has a geometry designed in a fashion as to maximize the discharge efficiency of the static wick. The purpose of static wick 300 is to discharge electric voltage into the air. Thus, static wick 300 helps to reduce the accumulation of static energy by dissipating static charge which tends to accumulate on electrically conductive elements of paint sprayer 10A.

A second feature of the electrostatic discharge protection system is provided by the body of front valve 52 and nut 32, which are formed of nonconductive materials, such as plastic, rather than being metal parts. The use of nonconductive materials to form valve 52 and nut 32 isolates spray tip assembly 14 from pump assembly 18, prevents conduction of electrostatic energy, and reduces electric capacitance of spray gun 10A to lower electrostatic energy and maximum possible discharge energy.

A third feature of the electrostatic discharge protection system incorporated within spray gun 10A is the use of nonconductive barriers to increase discharge travel distance. Examples of nonconductive barriers include barrier 310 located near first end 302 of static wick 300 and pump assembly 18, barriers 312 and 314 located within handle 34, and barriers 316 and 318 located within battery compartment 26.

A fourth feature of the electrostatic discharge protection system is the use of nonconductive material to form fluid reservoir 16 and suction tube 48. The use of nonconductive materials prevents static conduction and helps to reduce overall electric capacitance of spray gun 10A.

A fifth feature of the electrostatic discharge protection system is nonconductive coating 229A and nonconductive spring retainer 208 shown in FIG. 6. These nonconductive features isolate high voltage within housing 12 from the exterior of spray gun 10A.

The electrostatic discharge protection system incorporated in spray gun 10A regulates and isolates electrostatic energy to levels that minimize the risk of igniting flammable gases. This is achieved without a connection to earth ground. This reduces the risk involved in the application of flammable based materials and coatings with a handheld spray device.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A handheld fluid dispensing device comprising:

a fluid delivery device;

a spray tip or nozzle for atomizing fluid supplied by the fluid delivery device; and an electrostatic discharge protection system including at least one of: an electrically conductive static wick having a first end connected to an electrostatic charge accumulating component of the device and a second end exposed to atmosphere; a valve formed of nonconductive material and connected between a pump and the spray tip; a barrier adjacent the fluid delivery device; a plurality of nonconductive components positioned to electrically isolate the spray tip from the fluid delivery device; or, a nonconductive coating on a component of the control valve.

2. The device of claim 1, wherein the electrostatic discharge protection system includes a valve connected between a pump and the spray tip that is formed of nonconductive material.

3. The device of claim 2, wherein the electrostatic discharge protection system further includes a nut of nonconductive material that connects the spray tip to the valve.

4. The device of claim 2, wherein the electrostatic discharge protection system further includes a fluid reservoir for containing fluid to be pressurized and atomized and a suction tube for delivering the fluid from the fluid reservoir to the fluid delivery device, the fluid reservoir and the suction tube being formed of nonconductive material.

5. The device of claim 1, wherein the electrostatic discharge protection system includes a plurality of nonconductive barriers positioned to increase electrostatic discharge travel distance.

6. The device of claim 5, wherein the nonconductive barriers include a barrier adjacent the fluid delivery device.

7. The device of claim 5, wherein the nonconductive barriers include a barrier within a handle portion of the device.

8. The device of claim 5, wherein the nonconductive barriers include a barrier adjacent to a component of the device on which charge can accumulate.

9. The device of claim 1, wherein the electrostatic discharge protection system includes a plurality of nonconductive components positioned to electrically isolate the spray tip from the fluid delivery device.

10. The device of claim 1, wherein the electrostatic discharge protection system is configured to reduce or prevent accumulation or discharge of static energy without an earth ground connection.

11. The device of claim 1 and further comprising:

a control valve connected to the fluid delivery device.

12. The device of claim 1, wherein the electrostatic discharge protection system includes a nonconductive coating on a component of the control valve.

13. The device of claim 12, wherein the control valve includes a nonconductive spring retainer, a valve stem and a valve body, and wherein the nonconductive coating is on the valve stem.

14. The device of claim 1, wherein the electrostatic discharge protection system comprises:

an electrically conductive static wick having a first end connected to a component of the device on which charge can accumulate and a second end exposed to atmosphere; and a plurality of nonconductive components positioned to electrically isolate the spray tip from the fluid delivery device.

15. The device of claim 14, wherein the electrostatic discharge protection system further includes a plurality of nonconductive barriers positioned to increase electrostatic discharge travel distance.

16. The device of claim 15, wherein the electrostatic discharge protection system includes a fluid reservoir for containing fluid to be pressurized and atomized and a suction tube for delivering the fluid from the reservoir to the fluid delivery device, the fluid reservoir and the suction tube being formed of nonconductive material.

17. The device of claim 16 and further comprising:

a control valve connected to the fluid delivery device, wherein the electrostatic discharge protection system includes a nonconductive coating on a component of the control valve.

18. A handheld fluid dispensing device comprising:

a housing;

a fluid container connected to the housing;

a spray tip connected to an end of the housing, wherein the spray tip is configured to atomize fluid;

a fluid delivery device internal to the housing for delivering fluid from the fluid container to the spray tip;

a valve passing through a the housing and connecting the fluid delivery device to the spray tip within the housing;

a power source connected to the housing away from the spray tip, for delivering power to the fluid delivery device;

a trigger connected to the housing for controlling the power source; and an electrostatic discharge protection system including at least one of: an electrically conductive static wick having a first end connected to an electrostatic charge accumulating component within the housing and a second end exposed to atmosphere; a barrier adjacent the fluid delivery device; a plurality of nonconductive components positioned to electrically isolate the spray tip from the fluid delivery device; or, a nonconductive coating on a component of the control valve.

19. The handheld fluid dispensing device of claim 18, wherein the plurality of nonconductive components are positioned within the housing.

20. The device of claim 1, wherein the electrostatic discharge protection system is configured to reduce or prevent accumulation or discharge of static energy without an earth ground connection.

21. The handheld fluid dispensing device of claim 18 and further comprising a handle connected to the housing, wherein the handle is positioned away from the spray tip.

22. The handheld fluid dispensing device of claim 21, wherein the trigger is located on the handle and is positioned near a connection between the handle and the housing.

23. The handheld fluid dispensing device of claim 18, wherein the valve is formed of a nonconductive material, electrically isolating the spray tip from the fluid delivery device to prevent conduction of electrostatic energy from the fluid delivery device.

24. The handheld fluid dispensing device of claim 18, wherein the nonconductive barriers include a barrier adjacent the fluid delivery device.

25. The handheld fluid dispensing device of claim 18, wherein the nonconductive barriers include a barrier within a handle connected to the housing.

26. The handheld fluid dispensing device of claim 18, wherein the nonconductive barriers include a barrier adjacent to the power source.

27. A handheld fluid dispensing device comprising:

a housing;

a fluid container connected to the housing;

a spray tip connected to the housing, wherein the spray tip is configured to atomize fluid;

a fluid delivery device within the housing for delivering fluid from the fluid container to the spray tip;

a battery power source connected to the housing for electrically powering the fluid delivery device; and an electrostatic discharge protection system including at least one of: an electrically conductive static wick having a first end connected to an electrostatic charge accumulating component of the device and a second end exposed to atmosphere; a valve connected between a pump and the spray tip that is formed of nonconductive material; a barrier adjacent the fluid delivery device; a plurality of nonconductive components positioned to electrically isolate the spray tip from the fluid delivery device; or a nonconductive coating on a component of the control valve.

28. The handheld fluid dispensing device of claim 27 and further comprising a handle connected to the housing and positioned away from the spray tip.

29. The handheld fluid dispensing device of claim 28, wherein the battery power source releasably connects to the handle.

30. The handheld fluid dispensing device of claim 28, wherein the housing connects to a first end of the handle and the battery power source connects to a second end of the handle.

31. The handheld fluid dispensing device of claim 27, wherein the plurality of nonconductive barriers are positioned near the battery power source to increase discharge travel distance.

* * * * *